US005086928A

United States Patent [19]

Lisiecki

[11] Patent Number: 5,086,928

[45] Date of Patent: Feb. 11, 1992

[54] FLAT TOP END CLOSURE FOR LIQUID CONTAINERS

[75] Inventor: Robert E. Lisiecki, W. Bloomfield, Mich.

[73] Assignee: Elopak Systems A.G., Glattbrugg, Switzerland

[21] Appl. No.: 623,789

[22] Filed: Dec. 7, 1990

[51] Int. Cl.[5] ..... B65D 5/74

[52] U.S. Cl. ..... 229/217; 229/137

[58] Field of Search ..... 206/621.6, 629, 631.1, 206/631.2; 229/137, 138

[56] References Cited

U.S. PATENT DOCUMENTS

| | | | |
|---|---|---|---|
| 3,269,644 | 8/1966 | Bump | 206/631.2 |
| 4,211,357 | 7/1980 | Lisiecki | 206/631.2 |
| 4,422,570 | 12/1983 | Lisiecki | 206/631.2 |
| 4,582,246 | 4/1986 | Lisiecki | 206/631.2 |
| 4,911,306 | 3/1990 | Lisiecki et al. | 206/631.2 |

*Primary Examiner*—Stephen Marcus
*Assistant Examiner*—Christopher McDonald
*Attorney, Agent, or Firm*—John P. Moran

[57] ABSTRACT

There is disclosed herein a flat top end closure for a liquid carrying container, which includes two oppositely disposed, overlapped outer closure panels, and two oppositely disposed, three-segment fold-in panels, one of which serves as the pour spout when opened. Each of the three-segment fold-in panels includes a substantially triangular panel portion defined by converging diagonal score lines extending from the upper edge of the tubular container body, and a pair of fold-back panels integrally connected to and folded between the substantially triangular panel portion and the respective adjacent outer closure panels. Diagonal opening-assist score lines are formed on the outer closure panels at a lesser angle with respect to horizontal than the angle of the respective underlying converging diagonal score lines. Alternatively, the diagonal opening-assist score lines are formed in a parallel relationship with the respective underlying converging diagonal score lines.

7 Claims, 6 Drawing Sheets

FLAT TOP END CLOSURE FOR LIQUID CONTAINERS

TECHNICAL FIELD

This invention relates generally to thermoplastic coated paperboard containers for carrying liquids and blanks for constructing same and, more particularly, to an improved, easy openable flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same is conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example, in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force against the outside panel to bend the sealed fin downwardly.

In U.S. Pat. No. 4,206,867, a wide score line is formed on one side of the gable panels, in lieu of the above mentioned double score lines, with a conventional score line of the opposite side providing unequal fold-back panels.

In the above-mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

U S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tab is integrally formed on one outer closure panel for initial lifting of a portion of the pitcher pour spout, and an underlying lift tab is formed on one fold-back closure panel of another portion of the pitcher pout spout, in order to facilitate the opening process.

In liquid carrying paperboard container constructions generally, for sensitive food products, such as milk or fruit juice, it is essential that the top closure be thoroughly sealable so as to be clean and sanitary and yet be functional from the standpoint of including means for readily opening the pouring spout thereof. As illustrated and described in the above-mentioned U.S. Pat. No. 3,270,940, anti-adhesive or "abhesive" patterns have been utilized, primarily on one or both sides of the rib panels located outward of the infolded triangular fold-back panels and inward of the outer edge sealing flaps. In the flat top structure disclosed in the above-mentioned U.S. Pat. No. 4,422,570, wherein there is no conventional sealing fin, such as the usual rib panels and sealing flaps, other arrangements for releasably sealing the top closure are required.

U.S. Pat. No. 4,582,246 discloses a flat top closure of the non-sealing fin type disclosed in the above-mentioned U.S. Pat. No. 4,422,570, and including predetermined inner and outer surface adhesive patterns, and an optional embossment filled with a supplementary sealant material, and/or partial cut lines which serve to facilitate the container opening operation.

DISCLOSURE OF THE INVENTION

A general object of the invention is to provide an improved flat top end closure for a liquid carrying, paperboard container, wherein various features are included for enhancing the separation of the pouring spout panels as the spout is folded back by the user.

Another object of the invention is to provide a flat top end closure, including improved opening-assist score lines which cause the pouring spout panels to separate with sufficient mechanical advantage to efficiently rupture the usual adhesion between the cooperating pouring spout panels.

A further object of the invention is to provide a flat top end closure including opening-assist score lines which are skewed with respect to the adjacent pouring spout score lines serving to automatically cause both sides of the pouring spout to separate and open correctly.

Still another object of the invention is to provide a flat top end closure including alternate opening-assist score lines which are spaced in a parallel relationship to the adjacent pouring spout score lines to enhance the pouring spout opening operation.

These and other objects and advantages of the invention will be apparent when reference is made to the following description and accompanying drawings.

BRIEF DESCRIPTION OF THE DRAWINGS

FIGS. 10, 11, 12, and 13 are views similar to FIGS. 3, 4, 5, and 7, but relative to the FIG. 9 embodiment.

BEST MODE OF CARRYING OUT THE INVENTION

Figure 1:
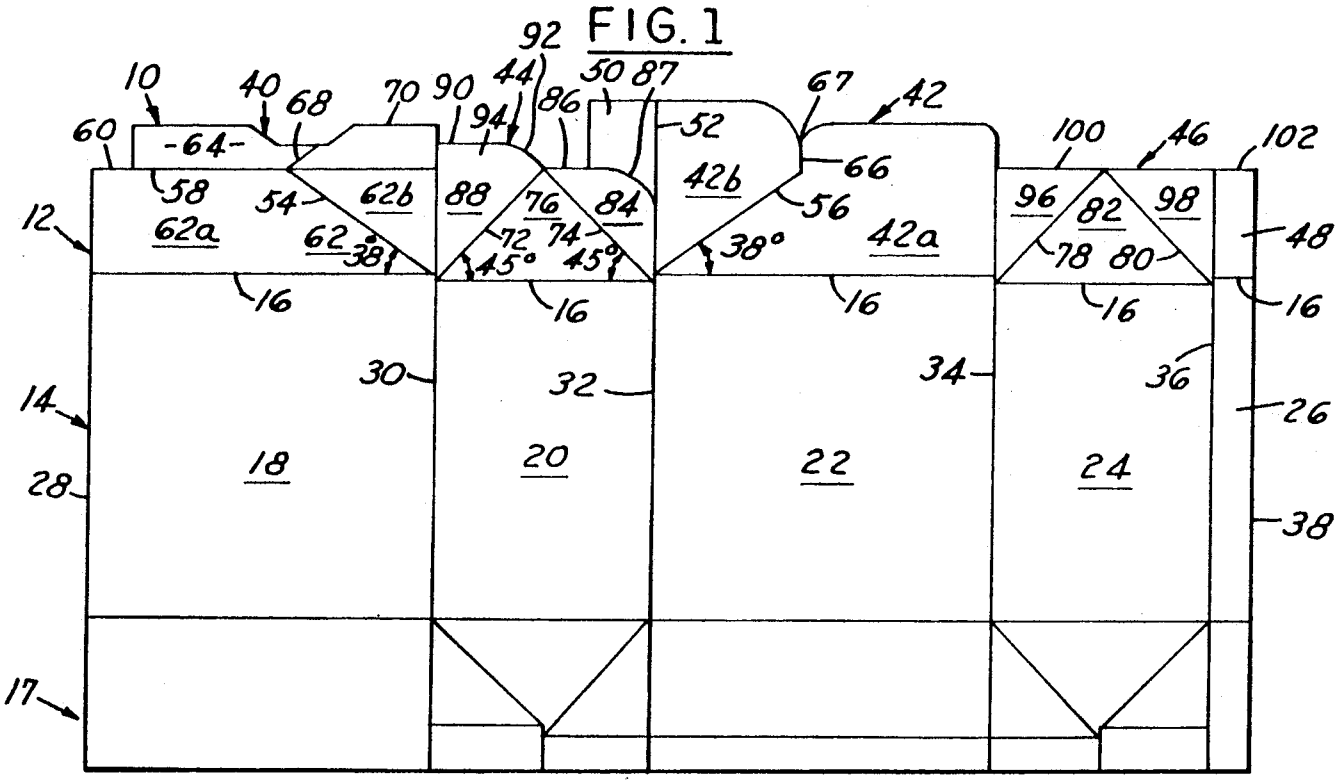
FIG. 1 is a layout view of a blank from which the top end closure of the invention is formed, showing the outside surface thereof.

Referring now to the drawings in greater detail, FIG. 1 illustrates the outside surface of a blank 10 including a top closure 12, a body portion 14, separated by a staggered horizontal score line 16, and a bottom closure portion 17 which forms no part of the invention. The body portion 14 includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 36, and a second free cut edge 38.

A pair of outer top closure panels 40 and 42 are integrally connected to the first and second side panels 18 and 22, respectively, at the score line 16. A pair of fold-in top panels 44 and 46 are integrally connected to the front and back panels 20 and 24, respectively, at the score line 16. An end closure extension 48 of the side seam 26 is integrally connected to the latter at the score line 16 and to the fold-in panel 46 at the extension of the score line 36. The panel 44 will serve as a pour spout, as will be explained.

A lift tab 50 is formed on the upper edge portion of the top panel 42 so as to be integrally connected thereto by a score line 52, which is substantially an extension of the vertical score line 32. The lift tab 50 is separated from the adjacent panel 44 in a manner to be described.

Opening-assist diagonal score lines 54 and 56 are formed on the outer top panels 40 and 42, respectively. The score line 54 extends substantially from the intersection of the vertical score line 30 and the horizontal score line 16 to a horizontal score line 58 formed across the panel 40 at an angle of approximately 38 degrees with respect to the score line 16. The score line 58 terminates in a free cut edge 60, and divides the panel 40 into panels 62 and 64, while the diagonal score line 54 divides the panel 62 into segments 62*a* and 62*b*, the latter serving as a fold-back panel. The score line 56 extends at the 38 degree angle from the intersection of the score lines 32 and 16 to a point on the panel 42 approximately on line with the score line 58. A short vertical weakened line 66 extends from the end of the diagonal score line 56 to a notch 67 formed in the edge of the panel 42, completing the division of the panel 42 into segments 42*a* and 42*b*, the lift tab 50 extending from the segment 42*b* and the latter serving as a fold-back panel. A diagonal score line 68 is formed across the panel 64 from the end of the diagonal score line 54 at the score line 58, to the free cut edge 70 of the panel 64.

A pair of converging diagonal score lines 72 and 74 are formed on the fold-in top panel 44, forming a triangular pouring panel 76 with the horizontal score line 16. Likewise, a pair of converging diagonal score lines 78 and 80 are formed on the fold-in top panel 46, forming a triangular panel 82 with the horizontal score line 16. The diagonal score lines 72, 74, 78 and 80 are preferably formed such that they substantially intersect the junctures of the score lines 30 and 16, 32 and 16, 34 and 16, and 36 and 16, respectively, at an angle of approximately 45 degrees with respect to the horizontal score line 16.

The panel 44 further includes a pair of fold-back panel segments, one of which is a segment 84 formed between the score lines 74 and 32 and an edge consisting of a straight portion 86 and an arcuate edge portion 87 cut apart from the adjacent lift tab 50. As noted in FIG. 1, the arcuate shape of the cut-apart edge 87 provides a wider base at the score line 52 than the width of the free end of the lift tab 50. The wider base serves to inhibit the start of a tear at the base of the lift tab during the subsequent opening action. The other fold-back panel segment is a longer segment 88 formed between the score lines 72 and 30 and an edge consisting of a straight portion 90 and a portion 92 which extends at angle between the adjacent ends of the edges 86 and 90, with one end substantially aligned with the diagonal score line 74 and the other end arcuately connected to the free cut edge 90.

It is the area of the longer panel portion 88 which extends beyond a continuation of the line formed by the straight edge portion 86 which is adapted to serve as a lift tab 94, as will be explained.

The fold-in panel 46 includes fold-back panel segments 96 and 98. The panel segment 96 is defined by the score lines 78 and 34 and a straight free cut edge 100 of the panel 46. The panel segment 98 is defined by the score lines 80 and 36 and a straight free cut edge 100. A free cut edge 102 at the end of the side seam extension 48 aligns with the straight edge 100.

Figure 2:
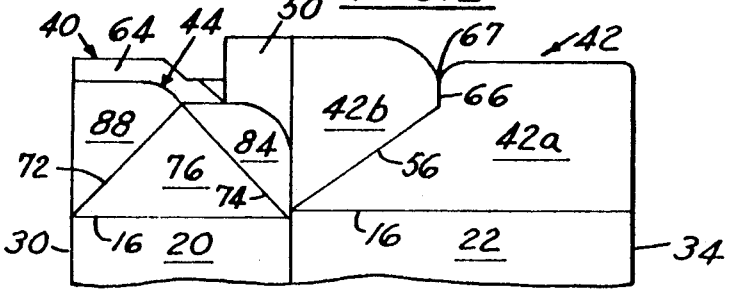
FIG. 2 is a fragmentary layout view of the outside surface of a blank after it is side seamed from the blank illustrated in FIG. 1.

The container blank 10 illustrated in FIG. 1 is formed into a side seamed blank, as illustrated in FIG. 2, by rotating the body panel 24 and the side seam flap 26 as a unit about the vertical score line 34, and having the inside surfaces of the body panel 24 and the side seam flap 26 come into contact with the inside surface of the body panel 22. The body panel 18 is then rotated about the vertical score line 30 to bring its inside surface into contact with the inside surface of the front panel 20 and the outside surface of the side seam flap 26, and the edge 28 is positioned parallel and substantially aligned with the vertical score line 36. The various members of the end closure 12 will make similar movements, and the container will appear as illustrated in FIG. 2. The container blank 10 is then sealed where the inside areas of the body panel 18 and the closure panel 40 come into contact with the outside surface of the side seam flap 26 and its extension 48.

Figure 3:
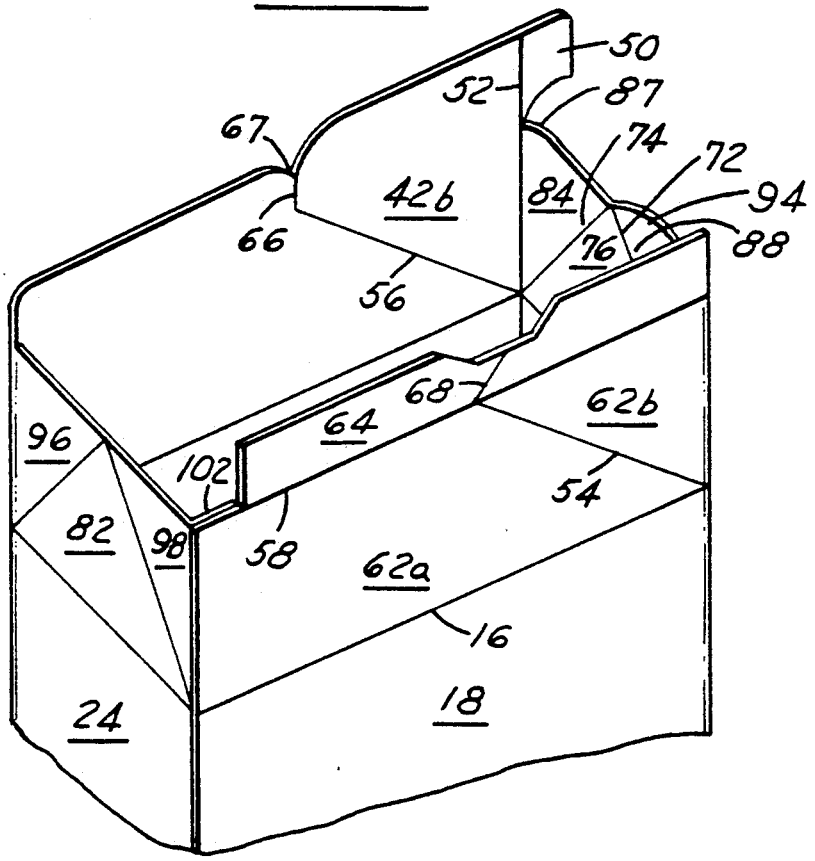
FIG. 3 is a fragmentary perspective view illustrating the top end closure after the side seamed blank of FIG. 2 has been opened into a tubular condition.
Figure 4:
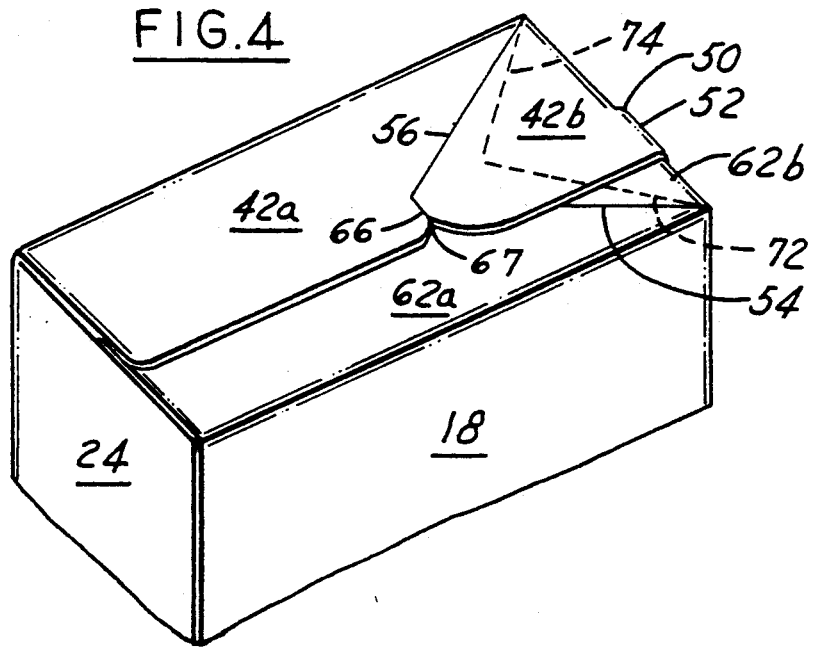
FIG. 4 is a fragmentary perspective view illustrating the flat top end closure after the FIG. 3 structure has been folded and sealed.

The next step in forming the side seam blank into a container is illustrated in FIG. 3. The side seam blank is opened up into one of a predetermined squared or rectangular configuration, after which the various parts of the end closure 12 are folded about the various score lines in the following manner. As may be noted from FIG. 4, the triangular closure panels 76 and 82 are moved around the horizontal score line 16 over the end of the container toward each other. At the same time, the outer panels 40 and 42 are also moved toward each other about the horizontal score line 16. This causes the fold-back panel segment 88 to bend around the vertical score line 30 such that the inside surfaces of the panel segment 88 and the outer panel 40 are approaching each other. Concurrently, the fold-back panel segment 84 is moved around the diagonal score line 74 such that the inside surfaces of the panel segment 84 and the panel 42 are approaching each other. The outside surfaces of the two fold-back panel segments 88 and 84 approach the outside of the triangular panel 76. The fold-back panel segments 96 and 98 make the same movements as described for the panel segments 84 and 88, with respect to their adjacent panels 42 and 82, and 40 and 82, respectively.

Figure 6:
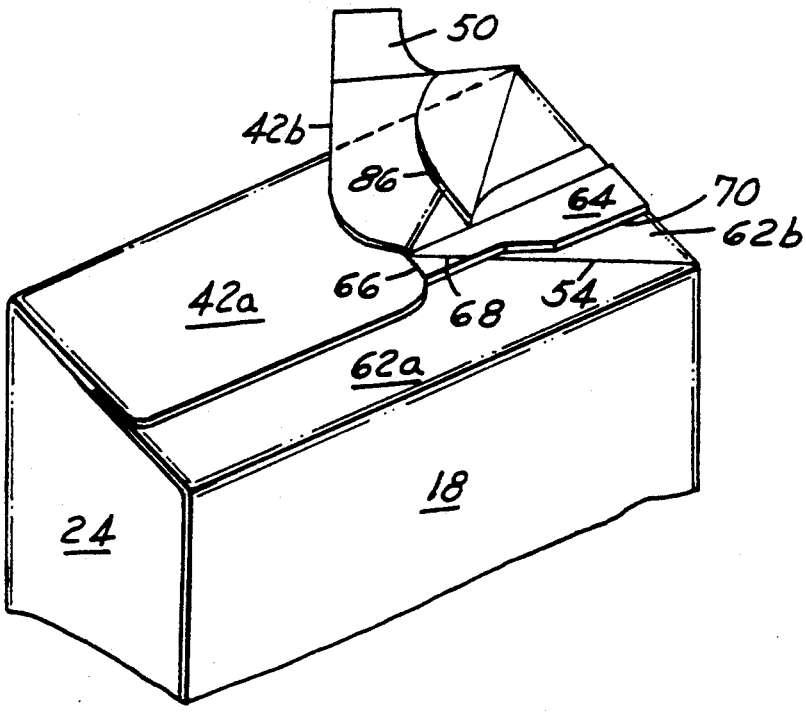
Figure 7:
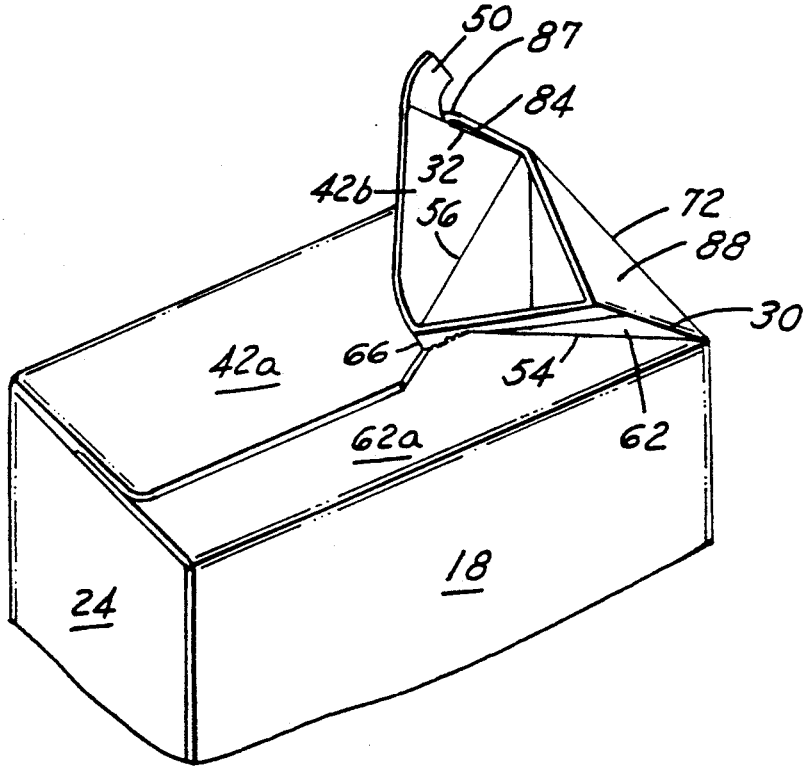

During the folding operation, the outer panel 42 contacts the panel portion 64 of the outer panel 40. The panel portion 64 is moved around the score line 58, approaching the panel portion 62. The result, as shown in FIGS. 6 and 7, is that an edge portion (FIG. 5) of the outer panel 42 overlaps and is sealed to the panel portion 64 (FIG. 5) of the outer panel 40, and the edge portion 94 of the panel 88 underlies the edge portion of the panel segment 84.

The lift tab 50 (FIG. 4) may be bent downwardly about the score line 52 and sealed against the front panel 20 to accommodate shipping and stacking.

Figure 5:
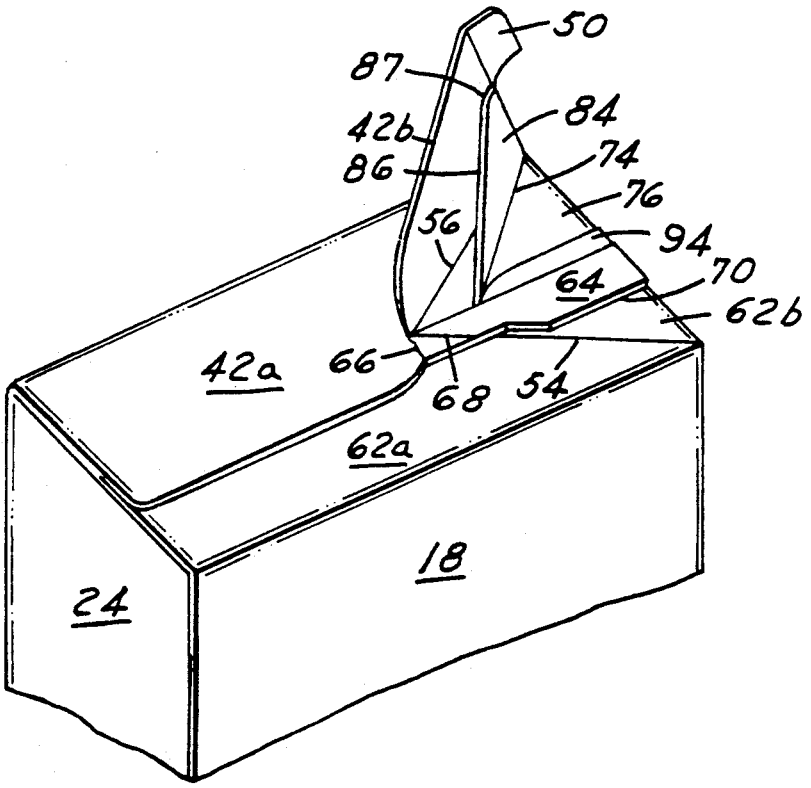
FIGS. 5, 6, and 7 are fragmentary perspective views illustrating sequentially various steps in opening the flat top end closure.
Figure 8:
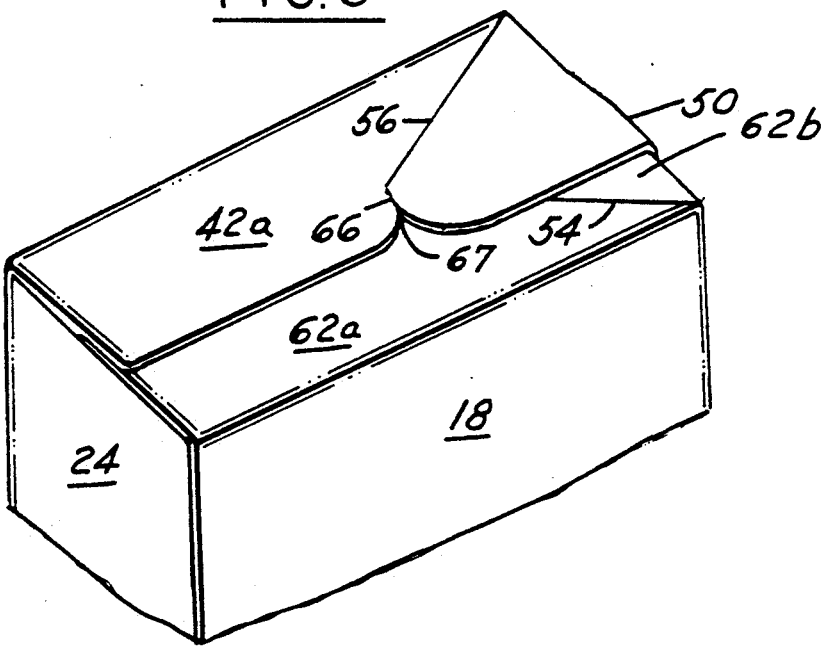
FIG. 8 is a fragmentary perspective view similar to FIG. 4, showing the top closure in a reclosed condition after having been opened.

Referring now to FIG. 5, it may be noted that opening of the flat top closure is effectuated by releasing the lift tab 50 from the front body panel 20 and then using the released tab lift the outer roof panel segment **42*b*, tearing the weakened line 66 and lifting the underlying panel segment 84. The panel segments 42*b* and 84 are moved about the respective diagonal score lines 56 and 74. This exposes the underlying portions of the panels 84, such that one may grasp the now exposed lift tab 94 portion of the panel 88, as defined by the free cut edges 90 and 92. Thus, by grasping and lifting the lift tab 94, the panel segments 88 and 62*b* are moved about the diagonal score lines 72 and 54, respectively. The score lines 72 and 54, being skewed, cause the adjacent panels to separate with sufficient mechanical advantage to rupture any residual adhesion between the adjacent spout panels. The pour spout shown in FIG. 7 is then opened as follows: the panel segments 76, 84 and 88 of the panel 44 are caused to assume a substantially planar attitude, with the skewed score lines 54, 72 and 56, 74 serving to cause the front spout panels 84 and 88 to automatically separate from the rear spout panels 42*b* and 62*b*, as shown in FIG. 6, whereupon pressure against the vertical edge score line 30 and 32 tends to cause the triangular panel portion 76 to extend outwardly. The lift tab 94 is then used to lift up the panel segment 88 and, hence, the triangular panel portion 76 and the panel segment 84 from their planar attitude and beyond, into the usual pitcher pour spout for dispensing the contents of the container. The pour spout may, of course, be generally reclosed after use. As shown in FIG. 8, the lift tab 50 may be tucked inwardly, between the fold-back panel 84 and the triangular pouring panel 76** to effectuate a "locking" condition for the reclosed flat top structure.

Figure 9:
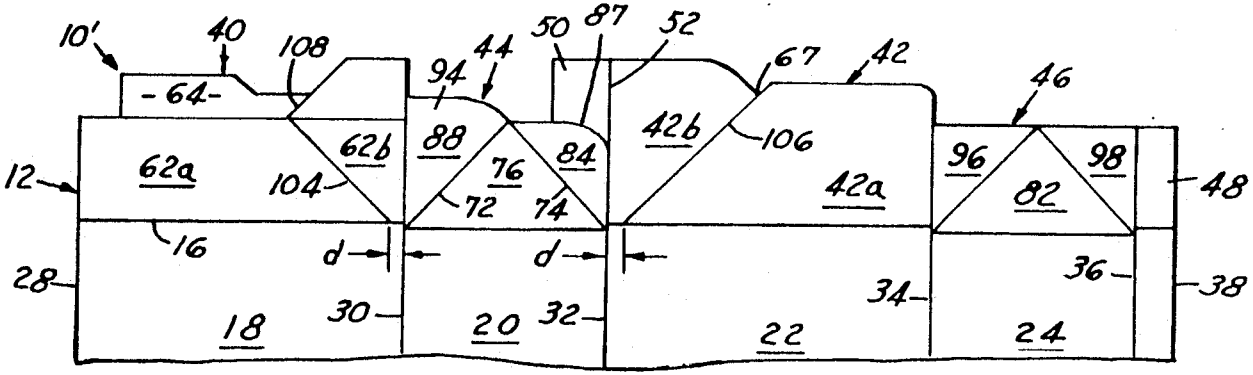
FIG. 9 is a view similar to FIG. 1 illustrating an alternate embodiment of the invention.

Referring now to the blank 10' of FIG. 9, elements which are identical to their counterparts in FIG. 1 bear the same reference numerals. Hence, it may be noted that, in lieu of the diagonal score lines 54 and 56, diagonal score lines 104 and 106, respectively, are formed, and, in lieu of the score line 68, a score line 108 is formed. The score lines 104 and 106 diverge from the horizontal score line 16 at substantially the same angle as the converging score lines 72 and 74, namely, 45 degrees, but with their lower termini spaced a predetermined distance d apart from the respective vertical score lines 30 and 32. The score line 106 extends substantially directly to the notch 67, omitting the interconnecting vertical score line 66 of FIG. 1.

Figure 11:
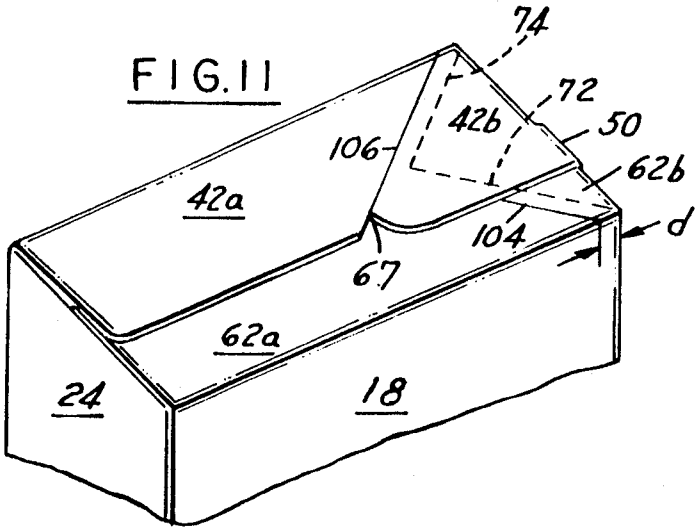
Figure 10:
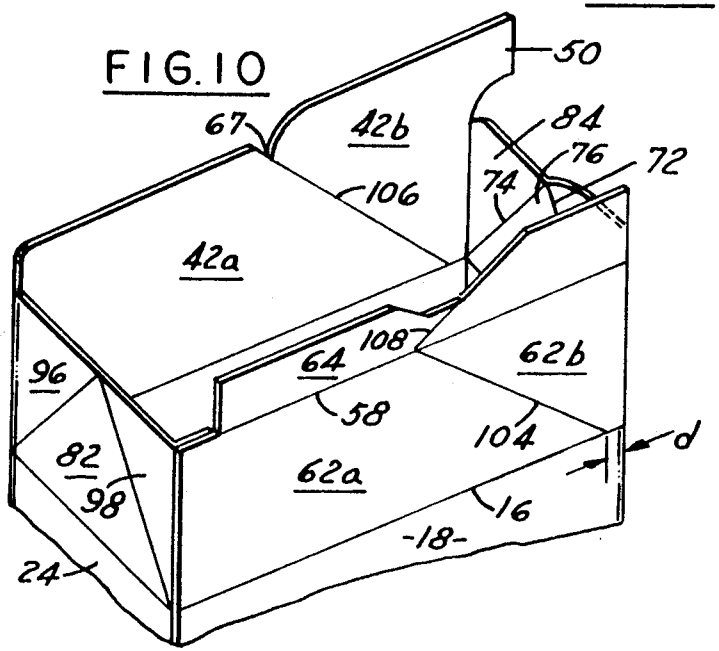
FIG. 10 is a view similar to FIG. 3, but relative to the FIG. 9 embodiment.
Figure 12:
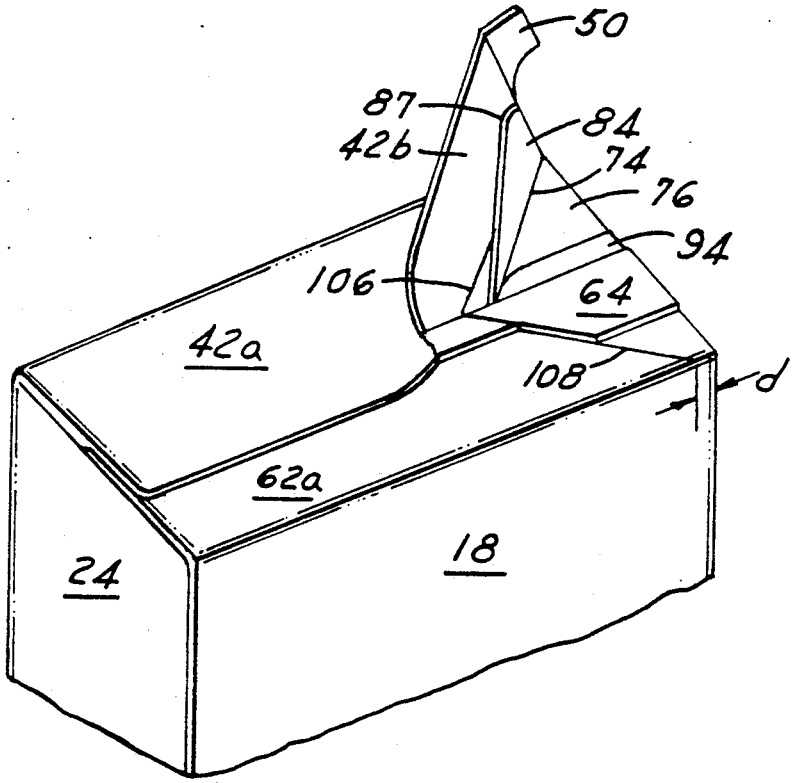
Figure 13:
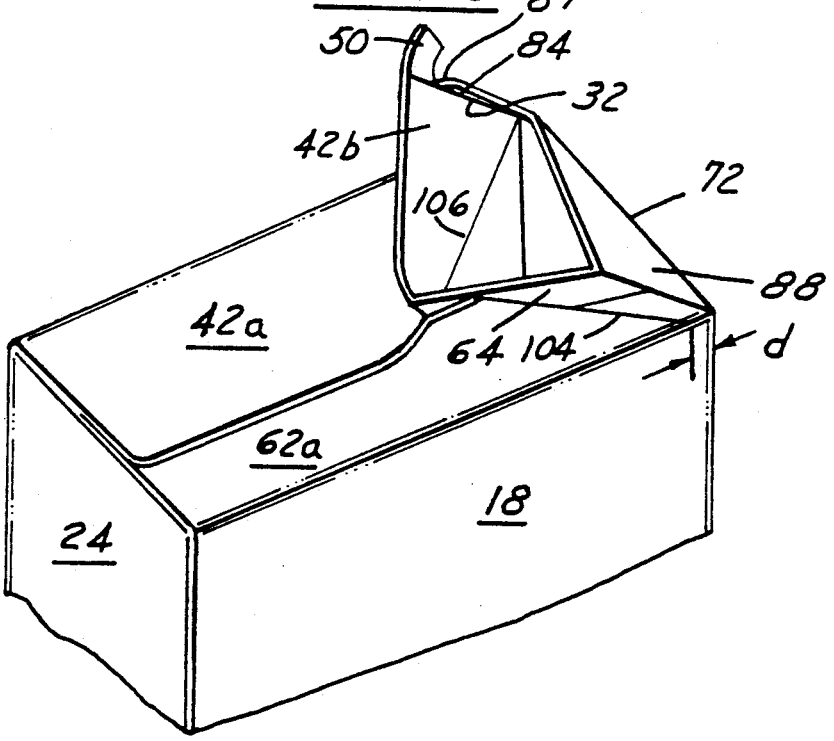

Once the container is closed, as shown in FIG. 11, it is noted that the score lines 104 and 106 are parallel to the underlying score lines 72 and 74, the distance d apart. In the opening process, as shown in FIGS. 12 and 13, the spaced apart score lines 104 and 106 serve substantially the same purpose as the skewed score lines 54 and 56 of FIG. 1.

INDUSTRIAL APPLICABILITY

It should be apparent that the flat top closure of the invention may be easily opened by virtue of the mechanical advantage resulting from the opening-assist score lines being spaced apart from the underlying converging diagonal score lines by one of a diverging angle relationship or a parallel relationship therewith.

It should also be apparent that the wide lift tab base, having been cut from the adjacent fold-back panel segment 84, covers a portion of the underlying center-line channel or crevice, thereby serving to trap any hot melt sealant that may be used in the channel for a more effective caulking action.

While but two embodiments of the invention have been shown and described, other modifications thereof are possible within the scope of the following claims.

The embodiments of the invention in which an exclusive property or privilege is claimed are defined as follows:

1. In a flat top end closure for a liquid carrying, thermoplastic-coated paperboard container having a tubular body and including two oppositely disposed infolded panels and two oppositely disposed outer closure panels, one of said infolded panels adapted to serve as a pouring spout, said inflolded panels each including a substantially triangular panel portion defined by converging diagonal score lines and being integrally connected to said tubular body, and a first pair of fold-back panels integrally connected to and folded between each of said substantially triangular panel portions and the respective adjacent outer closure panels, said two oppositely disposed outer closure panels including one shorter and one longer panel, with the edge portion of said longer panel overlapping the edge portion of said shorter panel and each having a diagonal opening-assist score line formed thereon to form a second pair of fold-back panels between said respective diagonal opening-assist score lines and said first pair of fold-back panels, a first lift tab formed on a side edge of said longer panel for lifting the portion of said overlying longer panel adjacent its diagonal opening-assist score line and the integrally connected underlying fold-back panel of said pouring spout, and a second lift tab formed on the other of said fold-back panels of said pouring spout for lifting said other fold-back panel and the portion of said overlying shorter closure panel adjacent its diagonal opening assist score line to enhance the opening of the infolded panel bearing said second lift tab into said pouring spout, characterized by said opening-assist score lines being formed so as to be at a constant angle with respect to said respective underlying converging diagonal score lines and spaced apart therefrom in a predetermined rearward orientation with respect to said pouring spout.

2. In the flat top end closure described in claim 1, wherein said opening-assist score lines are formed at a constant smaller angle with respect to horizontal than the angle of said respective converging diagonal score lines.

3. In the flat top end closure described in claim 1, wherein a notch is formed in the free cut edge of said longer outer closure panel, and a short vertical weakened line extends from one end of the opening-assist score line formed on said longer outer closure panel to said notch.

4. In the flat top end closure described in claim 1, wherein said opening-assist score lines are formed so as to be parallel to said respective underlying converging diagonal score lines.

5. In the flat top end closure described in claim 4, wherein a notch is formed in the free cut edge of said longer outer closure panel, and said opening-assist score line formed on said longer outer closure panel extends to said notch.

6. In the flat top end closure described in claim 1, wherein said first lift tab is formed so as to be wider where it connects to said side edge of said longer outer closure panel than it is at its outer edge, and the underlying fold-back panel is formed such that the wider portion of said first lift tab is originally cut from the outer edge portion thereof.

7. In the flat top end closure described in claim 1, and a fold-over panel segment formed on the end of said shorter top closure panel; a reverse diagonal opening-assist score line formed on said fold-over panel segment so as to be aligned with the underling opening-assist score line on said shorter top closure panel.

* * * * *

UNITED STATES PATENT AND TRADEMARK OFFICE

CERTIFICATE OF CORRECTION

PATENT NO. : 5,086,928

DATED : February 11, 1992

INVENTOR(S) : Robert E. Lisiecki; Michael F. Showler; Gonzalo D. Santiago

It is certified that error appears in the above-identified patent and that said Letters Patent is hereby corrected as shown below: Title page, item [75]:

Add as inventors:

Michael F. Showler
W. Blcomfield, Mich.

and

Gonzalo D. Santiago
Union Lake, Mich.

Signed and Sealed this

Fourth Day of May, 1993

*Attest:*

Michael K. Kirk

MICHAEL K. KIRK

*Attesting Officer*

*Acting Commissioner of Patents and Trademarks*